US009863221B2

(12) United States Patent
Tubel et al.

(10) Patent No.: US 9,863,221 B2
(45) Date of Patent: Jan. 9, 2018

(54) DOWNHOLE INTEGRATED WELL MANAGEMENT SYSTEM

(71) Applicant: Tubel, LLC, The Woodlands, TX (US)

(72) Inventors: Paulo Tubel, The Woodlands, TX (US); Rogelio Cantu, The Woodlands, TX (US); Jorge Laurent, The Woodlands, TX (US); Sagar Shinde, The Woodlands, TX (US); Richard Lee Tilotta, The Woodlands, TX (US); James Kendall Warren, The Woodlands, TX (US); Sergio Cornejo, The Woodlands, TX (US); John Batiste Laine, The Woodlands, TX (US); Amanda Lauren Tubel, The Woodlands, TX (US)

(73) Assignee: TUBEL ENERGY, LLC, The Woodlands, TX (US)

( * ) Notice: Subject to any disclaimer, the term of this patent is extended or adjusted under 35 U.S.C. 154(b) by 11 days.

(21) Appl. No.: 14/289,313

(22) Filed: May 28, 2014

(65) Prior Publication Data

US 2014/0352955 A1 Dec. 4, 2014

Related U.S. Application Data

(60) Provisional application No. 61/828,441, filed on May 29, 2013.

(51) Int. Cl.

| | |
|---|---|
| ***E21B 43/12*** | (2006.01) |
| ***E21B 44/00*** | (2006.01) |
| ***E21B 47/12*** | (2012.01) |

(52) U.S. Cl.
CPC ..... *E21B 43/12* (2013.01); *E21B 44/005* (2013.01); *E21B 47/12* (2013.01)

(58) Field of Classification Search
CPC ..... E21B 43/12; E21B 34/006; E21B 47/12; E21B 44/005
See application file for complete search history.

(56) References Cited

U.S. PATENT DOCUMENTS 5,730,219 A * 3/1998 Tubel ..... E21B 47/10 166/113
6,061,000 A * 5/2000 Edwards ..... E21B 47/122 166/250.01

(Continued)

*Primary Examiner* — Giovanna C. Wright
*Assistant Examiner* — Manuel C Portocarrero
(74) *Attorney, Agent, or Firm* — Maze IP Law, PC

(57) ABSTRACT

Components of a downhole integrated well management system, and its method of use, can be deployed through tubing, a liner, or casing in existing wells without the need to deploy new pipe or remove and re-install pipe in the well. The system can seal the flow of hydrocarbon fluid and re-direct it into the claimed internal flow control module which, in embodiments, comprises a mandrel comprising one or more ports providing fluid communication between the interior of the mandrel and the outside of the mandrel and corresponding controllable port covers and/or seals that are adapted to open, partially open, or fully close a corresponding port; a flow controller; one or more sensor modules adapted to monitor a predetermined set of activities in a well; one or more communications module; and one or more power electronic modules. A surface module may be present and adapted to generate and transmit commands to the flow control modules and receive information from them.

20 Claims, 6 Drawing Sheets

(56) References Cited

U.S. PATENT DOCUMENTS

| | | | | |
|---|---|---|---|---|
| 6,899,178 | B2 * | 5/2005 | Tubel | E21B 41/00<br>166/313 |
| 8,281,865 | B2 * | 10/2012 | Joseph | E21B 34/066<br>137/601.13 |
| 2011/0127044 | A1 * | 6/2011 | Radford | E21B 10/322<br>166/373 |

* cited by examiner

DOWNHOLE INTEGRATED WELL MANAGEMENT SYSTEM

CROSS-REFERENCE TO RELATED APPLICATION

This application claims the benefit of priority under 35 U.S.C. §119(e) from U.S. Provisional Patent Application No. 61/828,441 entitled "Downhole Integrated Well Management System", filed May 29, 2012.

FIELD OF THE INVENTION

The invention relates to and addresses fluid flow control in wells, more specifically to hydrocarbon fluid flows in hydrocarbon wells.

BACKGROUND OF THE INVENTION

There is significant activity in the oilfield today to perform operations to optimize the production of hydrocarbons by remotely controlling the flow and remote sensor monitoring. Most of the work today is done using hydraulically actuated sliding sleeves that can be actuated remotely and/or by standard sleeves that can be actuated mechanically by intervening in the well. The systems have to be deployed as the production pipe is deployed and as part of the pipe string. Wells that do not have production pipe or where the production pipe has been deployed are not able to have a well management system installed.

Wells normally use multiple casing diameters to construct the wellbore. Cement is normally used to seal the space between the different casing diameters. Sometimes pressure builds up in the areas between the casings, causing the casings to eventually collapse.

The disclosed downhole integrated well management system provides the ability to deploy integrated systems in existing wells without the need to deploy new production pipe or to remove and re-install production pipe in the well. The claimed system can be deployed inside existing production tubing, casing, or open hole and used to seal the flow of hydrocarbon and re-direct it into the claimed internal flow control module.

The disclosed downhole integrated well management system can also integrate multiple functions inside the well and at the surface to optimize hydrocarbon production and to maximize the amount of hydrocarbon that is extracted from the reservoir. Furthermore, the claimed system can lower the risks and increase the safety of producing hydrocarbons by reducing the number of components installed in the well and the number of wellhead penetrations.

In some embodiments, the use of the claimed flow control module to release the pressure from the casing to the surface, e.g. by using a hollow tube, could prevent the collapse of casings deployed in the well. The system can use a pressure gauge to monitor the pressure and open or close the flow control ports based on pre-programmed pressure settings or by wireless communications using commands from the surface. Power can also be transferred between casings.

BRIEF DESCRIPTION OF THE FIGURES

The figures supplied herein disclose various embodiments of the claimed invention.

DETAILED DESCRIPTION OF VARIOUS EMBODIMENTS

In general, in its embodiments the downhole integrated well management system disclosed can be used for deployment in existing wells for 3CS ("Command, Control, Communications and Sensory") for multi zone applications in wellbores. The system provides an integrated, electrically operated system for flow control, remote communications, selective actuation capabilities, and sensory monitoring of production and reservoir parameters to provide an understanding of well production using 3CS techniques. Sealing of the well and latching of the system to secure the system at a desired location in the well are also features of embodiments of the claimed system.

The system can be used to choke the flow of fluids for production optimization. In an embodiment, the system also has ultralow power control for the opening and closing of flow ports for the flow path.

In embodiments, the system provides for real time, two-way, wired or wireless communications techniques for data and command transfer from the surface into the well and can even use production tubing or the earth as communication pathways. In these embodiments, the system is based on the use of two way communications for the generation of commands from the surface and to provide data from downhole to the surface.

Figure 1:
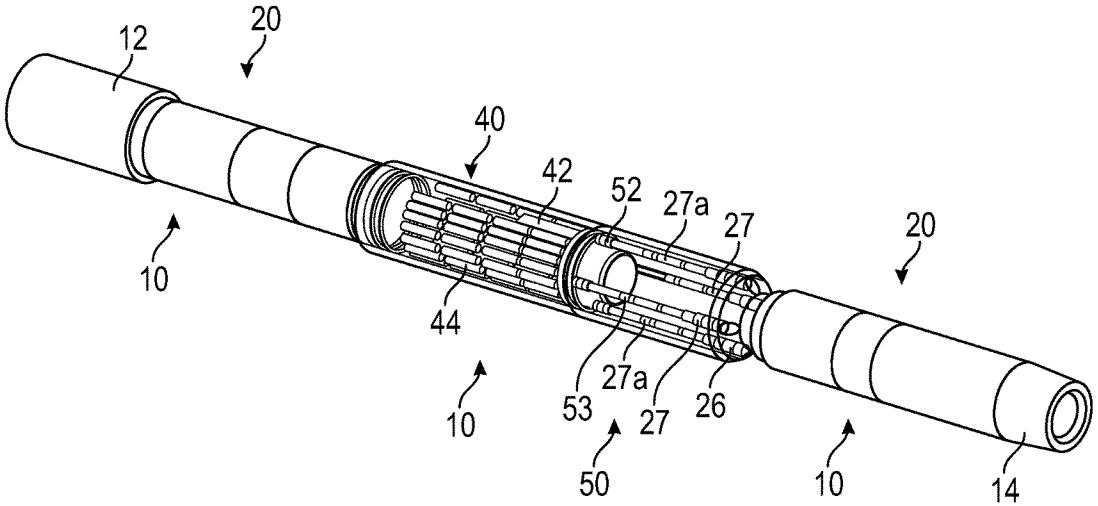
FIG. 1 is partially transparent, cutaway drawing in partial perspective of an exemplary module.
Figure 2:
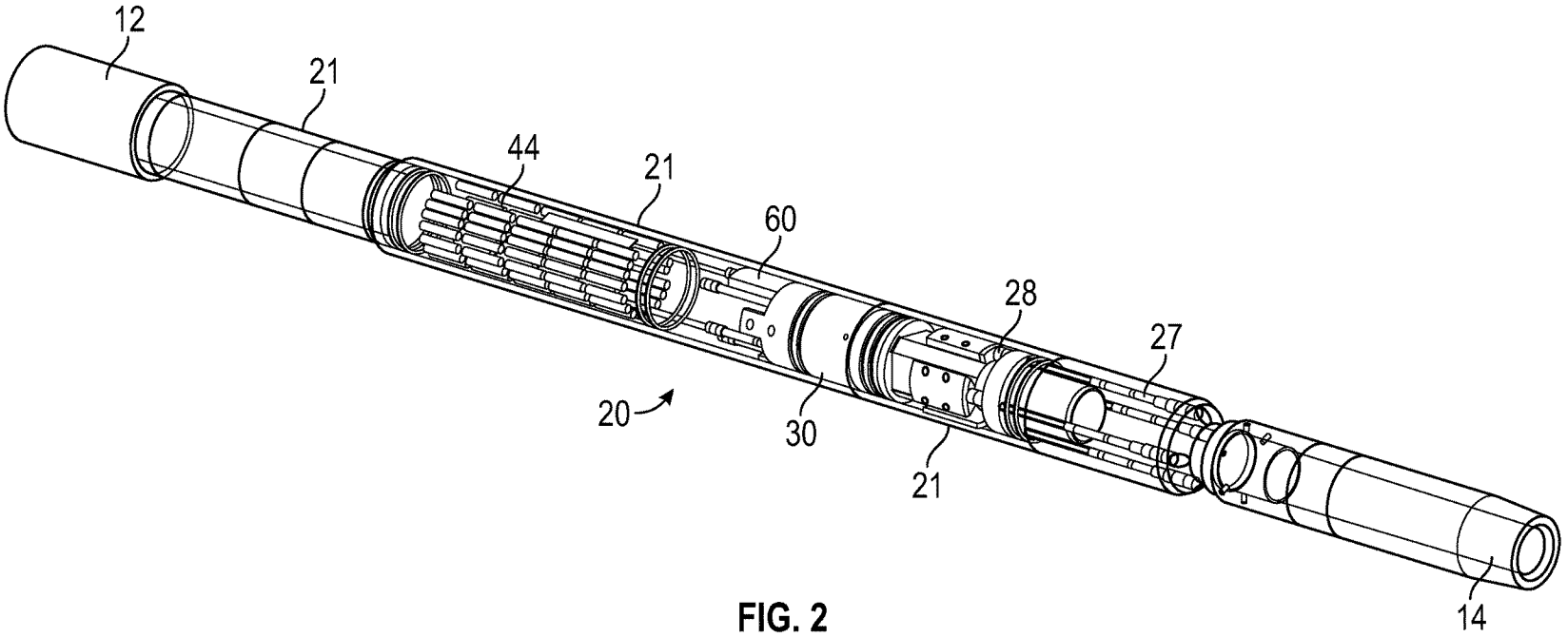
FIG. 2 is partially transparent, cutaway drawing in partial perspective of an exemplary module.

Referring now generally to FIGS. 1 and 2, in a first embodiment, electrically operated flow control module 10 comprises mandrel 20 having first coupling end 12 and second coupling end 14; flow controller 50 disposed within mandrel housing 21 (FIG. 2), where flow controller 50 is adapted to selectively engage and move one or more of a plurality of port covers 23 (FIG. 6) and/or plurality of port seals 27 (FIG. 6); sensor module 30 (FIG. 2) housed at least partially within mandrel 20; communications module 60 (FIG. 2) in communication with sensor module 30 and flow controller 50; and power electronic module 40 disposed within mandrel 20 and operatively in communication with flow controller 50, sensor module 30, and communications module 60. Electrically operated flow control module 10 is typically dimensioned to be deployed into well 100 (FIG. 7) through tubing, a liner, or casing.

Figure 5:
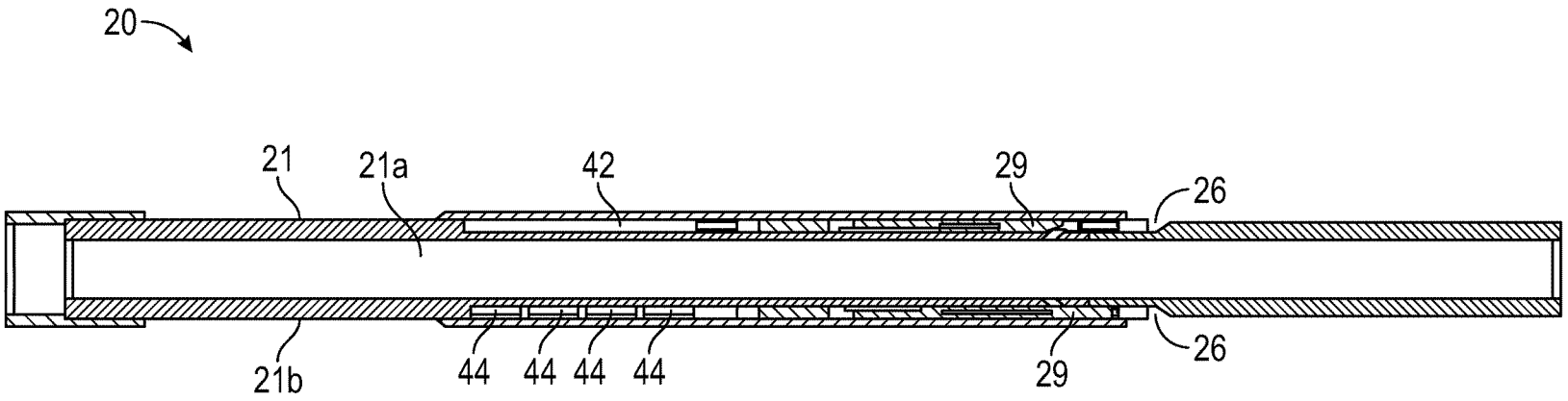
FIG. 5 is cutaway drawing in partial perspective of an exemplary module showing a port cover in a mandrel housing channel.

Referring additionally to FIG. 5, mandrel 20 typically comprises housing 21 which defines mandrel interior 21*a* and mandrel outside 21*b*; a plurality of ports 26 adapted to provide a fluid communication pathway between mandrel interior 21*a* and mandrel outside 21*b*; a plurality of port covers 23 (FIG. 6) adapted to change a diameter of a corresponding port 26; and a plurality of port seals 27 (FIG. 6) adapted to open, partially open, or fully close a corresponding port 26, thereby selectively allowing, partially allowing, or disallowing fluid flows in-between mandrel interior 21*a* and mandrel outside 21*b* through the corresponding port.

Port covers 23 (FIG. 6) may comprise any appropriate material, by way of example and not limitation including tungsten carbide.

In certain embodiments housing 21 comprises one or more channels 29 (FIGS. 3 and 4) and a corresponding set of port seals 27 which, in embodiments, comprise piston 27*a* (FIG. 1) slidingly disposed within a corresponding channel 29.

Referring back to FIG. 1, sensor module 30 may comprise a pressure sensor, a temperature sensor, a fluid flow sensor, a fluid identification sensor, a vibration sensor, an acoustic noise sensor, an induction sensor, a formation porosity sensor, a formation resistivity sensor, a seismic activity sensor, and/or a chemical composition sensor, or the like, or a combination thereof. As these are conventional elements, no separate drawing is necessary.

Figure 2A:
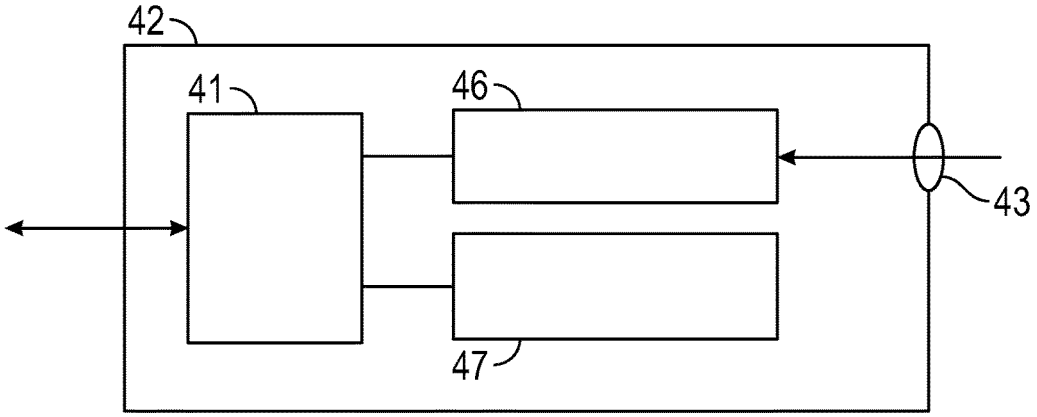
FIG. 2*a* is a block diagram of conventional components of the flow module's electronics.

Referring additionally to FIGS. 2 and 2*a*, power electronic module 40 may comprise an extremely low power electronic module and typically comprises a power source such as batteries 44. Power electronic module 40 may be further adapted to interface with communication module 60 to allow communications module 60 to transmit data. In certain embodiments, power electronic module 40 comprises electronics assembly 42 which further comprises microprocessor 41 (FIG. 2*a*); one or more analog to digital converters 46 (FIG. 2*a*) operatively in communication with microprocessor 41; and one or more analog ports 43 (FIG. 2*a*) operatively in communication with analog to digital converter(s) 46.

Figure 3:
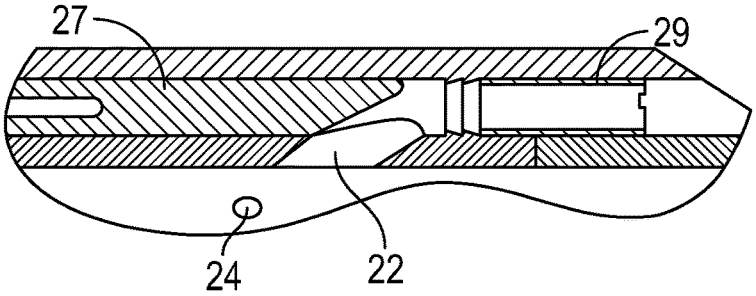
FIG. 3 is cutaway drawing in partial perspective of an exemplary module showing a piston in a mandrel housing channel in a open position.
Figure 4:
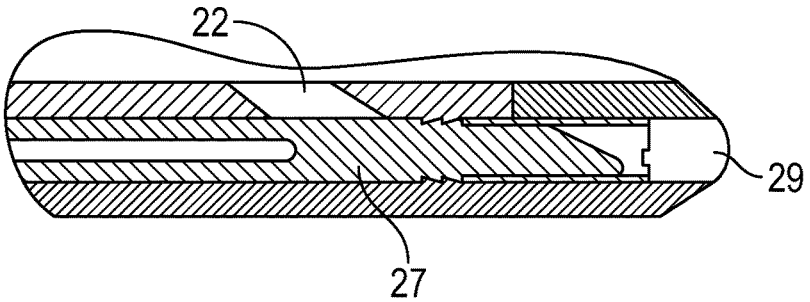
FIG. 4 is cutaway drawing in partial perspective of an exemplary module showing a piston in a mandrel housing channel in a closed position.

Referring back to FIG. 1, flow controller 50 typically comprises electric mover 52 operatively in communication with one or more of the plurality of port covers 23 (FIG. 6) and/or one or more of the plurality of port seals 27 (FIGS. 3 and 4). Electric mover 52 may comprise an ultralow power motor, a solenoid, or the like, or a combination thereof. One or more pressure balance transducers 53 may also be provided as can one or more motor bearing assemblies 52.

Communications module 60 is typically adapted to monitor a predetermined communications pathway for data and/or command transmissions. By way of example and not limitation, in an embodiment this monitoring comprises monitoring pressure fluctuations to determine if a wireless command has been received. Communications module 60 typically comprises tubing sensor 62 (FIG. 6) adapted to be used as a production value monitor and/or a communications pulse detector adapted to detect if a wireless command has been received.

Figure 7:
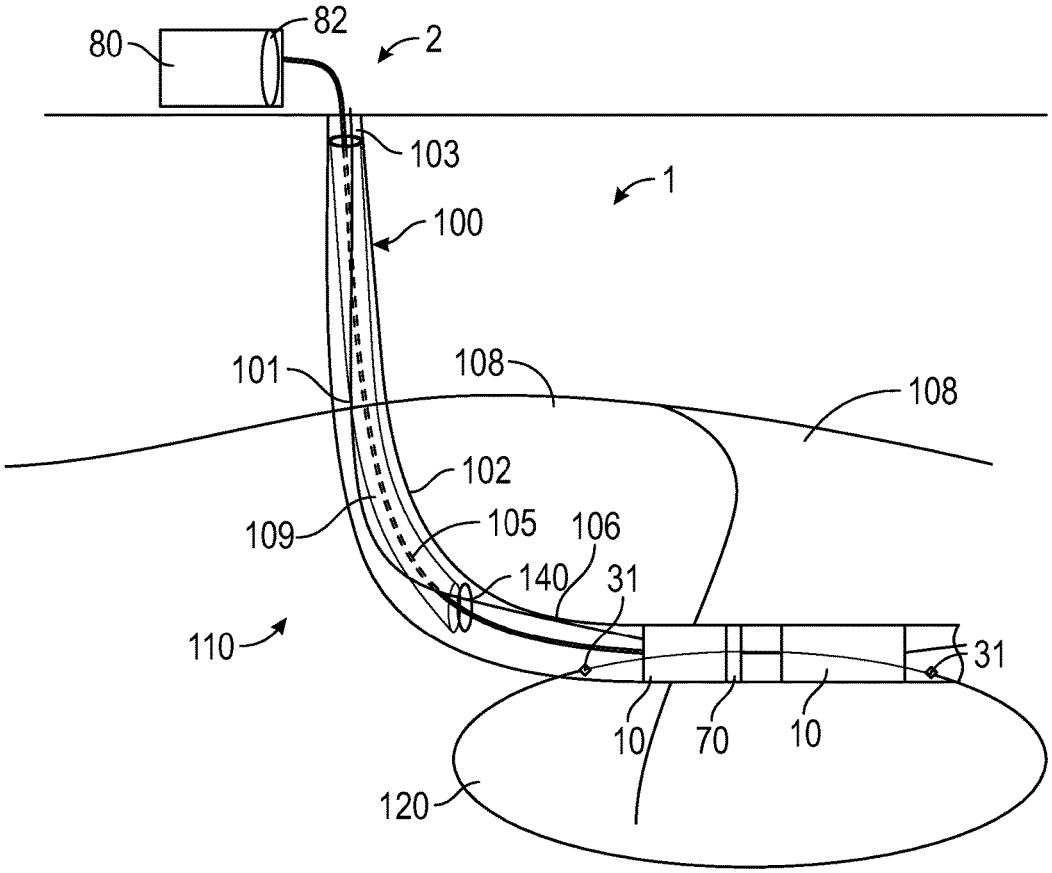
FIG. 7 is block diagram showing an exemplary system including an exemplary module deployed in a well.

Referring now to FIG. 7, in a further embodiment, downhole integrated well management system 1 comprises one or more electrically operated flow control modules 10 as described above as well as surface module 80 which is present and deployed at surface location 2. Surface module 80 is adapted to generate a command, transmit the command into well 100, and receive information from communications module 60 (FIG. 1) and may further be adapted to decode, store, and process data received from communications module 60. In embodiments, surface module 80 is further adapted to transfer data via either a universal serial bus USB to another surface module 80 and/or electrically operated flow control module 10 located on the same site or via the Internet to a secure website or a remote location.

In embodiments comprising a plurality of electrically operated flow control modules 10, each electrically operated flow control module 10 comprises a unique digital address.

Setting and sealing module 70 may additionally be present and disposed about module outer surface 21*b* (FIG. 5) where setting and sealing module 70 may be adapted to seal fluid flow path 110 inside well 100 so that the only path for the fluid moving from surface location 2 into reservoir 120 or from reservoir 120 to surface location 2 is through ports 26 (FIG. 1), e.g. the flow path is defined at least in part by through ports 26. In certain embodiments, setting and sealing module 70 is adapted to secure electrically operated flow control module 10 to a wellbore of well 100 at a predetermined location in well 100, such as a position which has been determined to be optimum for the control of well 100. If present, setting and sealing module 70 may comprise a packer.

In the operation of exemplary embodiments, referring still to FIG. 7, well 100 and its fluid flows may be controlled using downhole integrated well management system 1 without the need to deploy new production pipe or remove and re-install production pipe in the well. One or more electrically operated flow control modules 10 may be deployed into well 100 at a predetermined location within well 100, including inside existing production tubing 101 or an existing liner, existing casing 102, or an existing open hole 103, where electrically operated flow control module 10 is as described above. In certain embodiments electrically operated flow control module 10 may be deployed into well 100 as part of deploying casing 102 into well 100.

Surface module 80 is deployed at surface location 2, where surface module 80 is as described above and adapted to generate one or more commands transmit the commands into well 100 and receive information from one or more communications modules 60 (FIG. 1) deployed in well 100. Power electronic module 40 (FIG. 1), as described above, may comprise microprocessor 41 (FIG. 2*a*) located on electronic board 42 (FIG. 2*a*) which may be used to provide control commands to operate electric movers 52 (FIG. 1) and, in turn, to open and close port seals 27 (FIG. 1) as well as interface with motor location sensors 24 (FIG. 3) and digitize data obtained from motor location sensors 24. Microprocessor 41 may also be used to help provide data communications. Additionally, power electronic module 40 may further comprise data store 47 (FIG. 2*a*) operatively in communication with microprocessor 41 which can allow data acquired from flow control module 10 such as pressure, temperature, fluid identification and flow measurements, to be stored in data store 47 and transmitted to surface module 80. Data store 47 can be any appropriate data store, by way of example and not limitation including flash RAM.

In further embodiments, receiver 140 may be lowered into well 100 such as via a slickline and used to communicate with one or more electrically operated flow control modules 10. In these embodiments, stored data may be transmitted, e.g. wirelessly, to receiver 140 when receiver 140 or microprocessor 41 (FIG. 2*a*) issues a command to do so.

As noted above, power may be provided to power electronic module 40 (FIG. 1) by using one or more batteries 44 (FIG. 1). Additionally, in embodiments cable 105 may disposed in-between surface module 80 and one or more communications modules 60 (FIG. 1) and used as a data communication pathway and/or a power pathway. If cable 105 is present, power may be provided to power electronic module 40 by transmitting power from surface location 2 via cable 105 disposed inside well 100 and converting power received at power electronic module 40 into voltage and/or current levels required by the electronics and motor operation.

Data may be gathered representing various well characteristics such as by using sensor module 30 (FIG. 1) to obtain production and reservoir monitoring data. Production monitoring may comprise monitoring pressure fluctuation. To accomplish this data gathering, one or more sensors 31 are typically deployed in well 100, each sensor 31 being operatively in communication with sensor module 30, and used to monitor a predetermined characteristic of well 100 such as such as pressure, temperature, flow, fluid identification, vibration, acoustic noise, induction, porosity, and formation resistivity. The data may then be transmitted back to surface module 80 such as via communications module 60 (FIG. 1). Two way communications are typically established between surface module 80 and communications module 60 (FIG. 1) to promote the exchange of data and commands and data obtained from the one or more communications modules 60 by surface module 80. These two way communications between surface module 80 and communications module 60 may use pressure generator module 82, acoustic communications, and/or electromagnetics communications between surface location 2 and flow control modules 10 deployed downhole in well 100. These transmissions may be effected by using a wall of casing 102 as the transmission pathway. In other embodiments, production tubing 101 or the earth itself may be used to effect wireless communications between surface module 80 and one or more communications modules 60.

Generating a command at surface module 80 based on obtained data typically comprises processing data received from communications module 60 (FIG. 1) by surface module 80; generating a supervisory control and data acquisition command set by surface module 80; and transmitting the generated supervisory control and data acquisition command set to one or more flow control modules 10.

Figure 6:
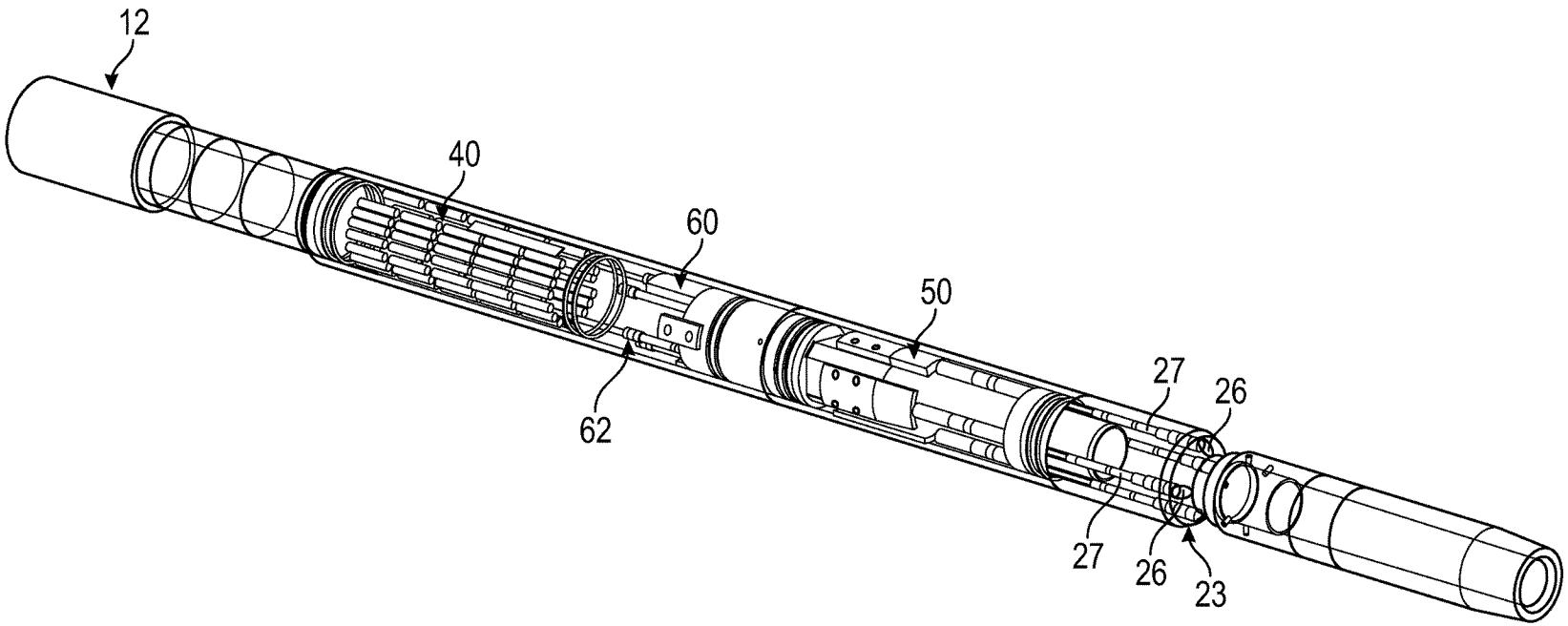
FIG. 6 is partially transparent, cutaway drawing in partial perspective of a partially exploded view of an exemplary module.

In certain embodiments communications module 60 further comprises tubing sensor 62 (FIG. 6) which may be disposed within interior 21*a* (FIG. 5) and used to monitor production and/or as a communications pulse detector to detect if a command has been received such as to open or close one or more port seals 23 (FIG. 6).

At times required by either data or other requirements, surface module 80 generates one or more commands which it transmits to an appropriate communications module 60 (FIG. 1). That appropriate communications module 60, e.g. one that has a digital address corresponding to the transmitted command or is associated with flow control module 10 that has the digital address, will then selectively open or close a desired port 26 (FIG. 1) based on the transmitted command using a port seal 27 (FIG. 4) which corresponds to the desired port 26.

Deployed flow control modules 10 may be programmed to continuously listen for commands from surface module 80. In some embodiments, data are provided between surface module 80 and communications modules 60 (FIG. 1) at pre-determined times and for predetermined durations such as to allow actuation of flow control tools 10. Further, although in some embodiments control and/or data acquisition commands may come from surface module 80, in other embodiments the data may be transmitted to surface module 80 automatically and periodically.

At times, it may be advantageous to relieve pressure in well 100 by sending one or more commands to open a predetermined number of the plurality of port seals 23 (FIG. 6) to release pressure in well 100 such as between casings 102. Alternatively, a predetermined number of the plurality of port seals 26 (FIG. 1) may be closed to block the pressure communications between well 100 and surface location 2. At times it may be advantageous to attach tube 106 to flow control module 10 where tube 106 is adapted to selectively allow release of pressure through flow control module 10 to surface location 2.

It may be desired to secure electrically operated flow control module 10 in well 100. In certain embodiments, electrically operated flow control module 10 may be cemented in well 100. If present, setting and sealing module 70, which is described above, may be used to seal fluid flow path 109 inside well 100 so that the only path for the fluid moving from surface location 2 into reservoir 120 or from reservoir 120 to surface location 2. This may be accomplished by using electrically operated flow control module ports 26 (FIG. 1) such as by using setting and sealing module 70 to seal well 100 and latch system 1 to secure system 1 at a desired location in well 100.

As noted above, a plurality of flow control modules 10 may be deployed in well 100, each flow control module 10 being adapted to allow for the simultaneous production of fluid from or injection of fluid into one of a plurality of sections 108 of well 100. As further noted above, each flow control module 10 may comprise a unique digital address. In these embodiments, a command may be generated by surface module 80 based on the obtained data for a specific unique flow control module digital address and the command transmitted to each of communications module 60 (FIG. 1) deployed in well 100. Each flow control module 10 then determines if the transmitted digital address matches the digital address of that flow control module 10 and flow control module 10 whose digital address matches the transmitted digital address then performs the command, e.g. by selectively opening, partially opening, partially closing, or fully closing one or more port seals 27 (FIG. 1) of that specific flow control module 10 to chock the flow, fully open, or fully close the well production at flow control module 10.

System 1 can also be configured to automatically turn one or more elements of flow control modules 10 on to open or close ports 26 (FIG. 1) based on programmed parameters stored in system 1 such as pressure levels.

The foregoing disclosure and description of the inventions are illustrative and explanatory. Various changes in the size, shape, and materials, as well as in the details of the illustrative construction and/or an illustrative method may be made without departing from the spirit of the invention.

What is claimed is:

1. An electrically operated flow control module, comprising:

a. a mandrel, comprising:

i. a housing defining an interior of the mandrel and an outside of the mandrel which is to be exposed to an interior of a wellbore;

ii. a plurality of ports extending through the interior of the mandrel to the outside of the mandrel, each port of the plurality of ports defining a fluid communication pathway between the interior of the mandrel and the outside of the mandrel into the interior of the wellbore;

iii. a plurality of port covers, each port cover corresponding to one port of the plurality of ports, each port cover operative to independently change a diameter of its corresponding port of the plurality of ports; and iv. a plurality of port seals, each port seal corresponding to one port of the plurality of ports, each port seal operative to open, partially open, or fully close its corresponding port of the plurality of ports and selectively allow, partially allow, or disallow fluid flows in-between the interior of the mandrel and the outside of the mandrel through its corresponding port;

b. an electrically operated flow controller disposed within the housing, the flow controller adapted to selectively engage and move each of the plurality of port covers or the plurality of port seals;

c. a sensor housed at least partially within the mandrel;

d. a communications module in communication with the sensor and the electrically operated flow controller; and e. an electronic power source disposed within the mandrel and operatively in communication with the electrically operated flow controller, the sensor, and the communications, the electronic power source comprising a power supply.

2. The electrically operated flow control module of claim 1, wherein:

a. the housing comprises a channel; and b. the port seals comprise a piston slidingly disposed within the channel.

3. The electrically operated flow control module of claim 1, wherein the sensor comprises at least one of a pressure sensor, a temperature sensor, a fluid flow sensor, a fluid identification sensor, a vibration sensor, an acoustic noise sensor, an induction sensor, a formation porosity sensor, a formation resistivity sensor, a seismic activity sensor, and a chemical composition sensor.

4. The electrically operated flow control module of claim 1, wherein the electronic power source further comprises:

a. a microprocessor;

b. an analog to digital converter operatively in communication with the microprocessor; and c. an analog port operatively in communication with the analog to digital converter.

5. The electrically operated flow control module of claim 1, wherein the electrically operated flow controller comprises an electric mover operatively in communication with one or more of the plurality of port covers or plurality of port seals.

6. The electrically operated flow control module of claim 5, wherein:

a. the electronic power source comprises a very low power electronic module; and b. the electric mover comprises at least one of an ultralow power motor or a solenoid.

7. The electrically operated flow control module of claim 1, wherein the transceiver is adapted to monitor a pressure fluctuation to determine if a wireless command has been received.

8. The electrically operated flow control module of claim 1, wherein the transceiver comprises a tubing sensor adapted to be used as at least one of a production value monitor and as a communications pulse detector adapted to detect if a wireless command has been received.

9. The electrically operated flow control module of claim 1, further comprising a setting and sealing module disposed about the outer surface of the module, the setting and sealing module adapted to seal a fluid flow path inside the well so that the only path for the fluid moving from the surface into a reservoir or from a reservoir to the surface are electrically operated flow control module ports.

10. A downhole integrated well management system, comprising:

a. a mandrel, comprising:

i. a housing defining an interior of the mandrel and an outside of the mandrel which is to be exposed to an interior of a wellbore;

ii. a plurality of ports extending in-between the interior of the mandrel and the exterior of the mandrel, each port of the plurality of ports defining a fluid communication pathway between the interior of the mandrel and the outside of the mandrel into the interior of the wellbore;

iii. a plurality of port covers, each port cover corresponding to one of the plurality of ports, each port cover operative to independently change a diameter of its corresponding port of the plurality of ports; and iv. a plurality of port seals, each port seal corresponding to one of the plurality of ports, each port seal operative to open, partially open, or fully close a corresponding port of the plurality of ports and selectively allow, partially allow, or disallow fluid flows in-between the interior of the mandrel and the outside of the mandrel through its corresponding port;

b. an electrically operated flow controller disposed within the housing, the flow controller adapted to selectively engage and move one or more of the plurality of port covers or the plurality of port seals;

c. a sensor housed at least partially within the mandrel, the sensor module adapted to monitor a predetermined set of activities in the wellbore;

d. a transceiver in communication with the sensor and the flow controller;

e. a power electronic module disposed within the mandrel and operatively in communication with the flow controller, the sensor, and the transceiver, the power electronic module comprising a power source; and f. a surface controller adapted to generate a command and transmit the command to and receive information from the transceiver.

11. The downhole integrated well management system of claim 10, wherein the electrically operated flow controller comprises a plurality of electrically operated flow controllers, each electrically operated flow controllers comprising a unique digital address.

12. A method of well control using a downhole integrated well management system without the need to deploy new production pipe or remove and re-install production pipe in a well, comprising:

a. deploying an electrically operated flow control module into a well to a predetermined location within the well, the electrically operated flow control module comprising:

i. a mandrel, comprising:

1. a housing defining an interior of the mandrel and an outside of the mandrel which is to be exposed to an interior of a wellbore;

2. a plurality of ports extending through the interior of the mandrel to the outside of the mandrel, each port of the plurality of ports defining a fluid communication pathway between the interior of the mandrel and the outside of the mandrel into the interior of the wellbore;

3. a plurality of port covers, each port cover corresponding to one of the plurality of ports, each port cover operative to independently change a diameter of its corresponding port of the plurality of ports; and 4. a plurality of port seals, each port seal corresponding to one port of the plurality of ports, each port seal operative to open, partially open, or fully close its corresponding port of the plurality of ports and selectively allow, partially allow, or disallow fluid flows in-between the interior of the mandrel and the outside of the mandrel through its corresponding port;

ii. an electrically operated flow controller disposed within the housing, the electrically operated flow controller adapted to selectively engage and move each of the plurality of port covers or the plurality of port seals;

iii. a sensor housed at least partially within the mandrel;

iv. a transceiver in communication with the sensor module and the flow controller; and v. an electronic power source disposed within the mandrel and operatively in communication with the electrically operated flow controller, the sensor, and the transceiver, the electronic power source adapted to interface with the transceiver to transmit data, the electronic power source comprising a power supply;

b. deploying a surface controller at a surface location, the surface controller adapted to generate a command, transmit the command to the transceiver, and receive information from the transceiver;

c. establishing two way communications between the surface controller and the transceiver;

d. obtaining data from the transceiver by the surface controller;

e. generating a command at the surface controller based on the obtained data;

f. transmitting the command to the transceiver; and g. selectively opening or closing a port based on the transmitted command using the port's corresponding port seal.

13. The method of well control using a downhole integrated well management system of claim 12, further comprising deploying the electrically operated flow control module into the well inside existing production tubing, an existing liner, an existing casing, or an existing open hole.

14. The method of well control using a downhole integrated well management system of claim 12, further comprising deploying the electrically operated flow control module into the well as part of deploying casing into the well.

15. The method of well control using a downhole integrated well management system of claim 12, further comprising cementing the electrically operated flow control module in the well.

16. The method of well control using a downhole integrated well management system of claim 12, further comprising attaching a tube to the flow control module, the tube adapted to allow release of pressure through the flow control module to the surface location.

17. The method of well control using a downhole integrated well management system of claim 12, further comprising:

a. opening a first predetermined number of the plurality of port seals to release pressure in the well between casings, either automatically based on programmed parameters stored in the system or via a generated command; and b. closing a second predetermined number of the plurality of port seals to block pressure communications between the well and the surface, either automatically based on programmed parameters stored in the system or via a generated command.

18. The method of well control using a downhole integrated well management system of claim 12, further comprising using wireless communications between the surface controller and the transceiver.

19. The method of well control using a downhole integrated well management system of claim 12, further comprising using at least one of production tubing, the earth, or a casing wall to effect two way data transfer, command transmission, and/or power transmission.

20. The method of well control using a downhole integrated well management system of claim 12, further comprising lowering a receiver into the well via a slickline to communicate with the electrically operated flow control module.

* * * * *